US007614479B2

(12) United States Patent
Plummer

(10) Patent No.: US 7,614,479 B2
(45) Date of Patent: Nov. 10, 2009

(54) SOUND ENHANCEMENT MODULE

(76) Inventor: Jan Plummer, 341 England Pl., NE., Marietta, GA (US) 30066

( * ) Notice: Subject to any disclaimer, the term of this patent is extended or adjusted under 35 U.S.C. 154(b) by 0 days.

(21) Appl. No.: 11/760,788

(22) Filed: Jun. 10, 2007

(65) Prior Publication Data

US 2008/0029335 A1 Feb. 7, 2008

Related U.S. Application Data

(63) Continuation-in-part of application No. 11/683,845, filed on Mar. 8, 2007, which is a continuation of application No. 10/709,538, filed on May 12, 2004, now Pat. No. 7,207,413.

(51) Int. Cl.
*G10K 15/04* (2006.01)

(52) U.S. Cl. ..... 181/199; 181/148; 181/151; 181/156; 381/345; 381/354

(58) Field of Classification Search ..... 181/198, 181/199, 207, 293, 196, 146, 151, 175, 176, 181/148, 156; 381/345, 354, 337, 348, 353
See application file for complete search history.

(56) References Cited

U.S. PATENT DOCUMENTS

| | | | | | |
|---|---|---|---|---|---|
| 4,356,882 | A * | 11/1982 | Allen | 181/151 |
| RE31,483 | E * | 1/1984 | Hruby, Jr. | 181/151 |
| 4,539,947 | A * | 9/1985 | Sawada et al. | 123/184.57 |
| 4,574,906 | A * | 3/1986 | White et al. | 181/145 |
| 4,591,020 | A * | 5/1986 | Hruby, Jr. | 181/145 |
| 4,714,133 | A * | 12/1987 | Skaggs, Jr. | 181/160 |
| 4,884,655 | A * | 12/1989 | Freadman et al. | 181/145 |
| 4,953,655 | A * | 9/1990 | Furukawa | 181/160 |
| 5,111,509 | A * | 5/1992 | Takeuchi et al. | 381/338 |
| 5,194,701 | A * | 3/1993 | Yamada-Scriba | 181/151 |
| 5,233,136 | A * | 8/1993 | Hamada | 181/152 |
| 5,261,006 | A * | 11/1993 | Nieuwendijk et al. | 381/353 |
| 5,324,896 | A * | 6/1994 | Magnani | 181/144 |
| 5,333,204 | A * | 7/1994 | Hamada et al. | 381/346 |
| 5,349,141 | A * | 9/1994 | Horibe et al. | 181/224 |
| 5,514,841 | A * | 5/1996 | Rochon | 181/156 |
| 5,550,921 | A * | 8/1996 | Freadman | 381/300 |
| 5,681,072 | A * | 10/1997 | Stricker | 296/39.3 |
| 5,731,553 | A * | 3/1998 | Ledoux | 181/156 |
| 5,740,259 | A * | 4/1998 | Dunn | 381/332 |
| 5,793,000 | A * | 8/1998 | Sabato et al. | 181/152 |
| 5,930,371 | A * | 7/1999 | Cheng et al. | 381/71.5 |
| 5,996,733 | A * | 12/1999 | DeTuncq et al. | 181/250 |
| 6,290,022 | B1 * | 9/2001 | Wolf et al. | 181/292 |
| 6,324,292 | B1 * | 11/2001 | Mitsuhashi et al. | 381/349 |
| 6,896,097 | B2 * | 5/2005 | Nishikawa et al. | 181/199 |
| 7,011,178 | B2 * | 3/2006 | Morkerken | 181/151 |
| 2004/0003962 | A1 * | 1/2004 | Gardner et al. | 181/199 |
| 2004/0105565 | A1 * | 6/2004 | Butters et al. | 381/347 |
| 2005/0155815 | A1 * | 7/2005 | Sasaki et al. | 181/151 |

FOREIGN PATENT DOCUMENTS

| | | | |
|---|---|---|---|
| EP | 456416 | A2 * | 11/1991 |
| JP | 62201355 | A * | 9/1987 |

* cited by examiner

*Primary Examiner*—Jeffrey Donels
*Assistant Examiner*—Jeremy Luks
(74) *Attorney, Agent, or Firm*—Kevin J. McNeely

(57) ABSTRACT

A sound enhancement module includes a set of walls that define an enclosed chamber, an aperture in one of the walls to provide a path for audio waves to travel between the enclosed chamber and an external space and an alternative density transmission medium positioned in the enclosed chamber.

18 Claims, 19 Drawing Sheets

A

B

A

B

A

B

Fig. 12A
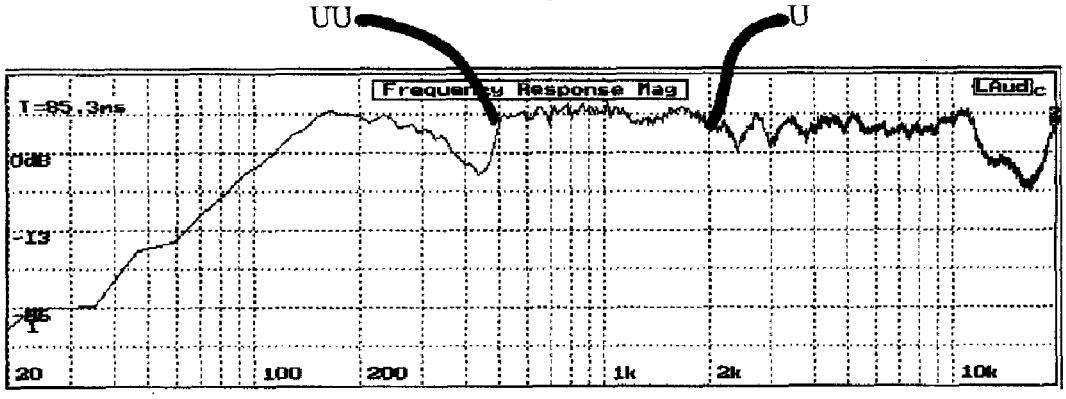
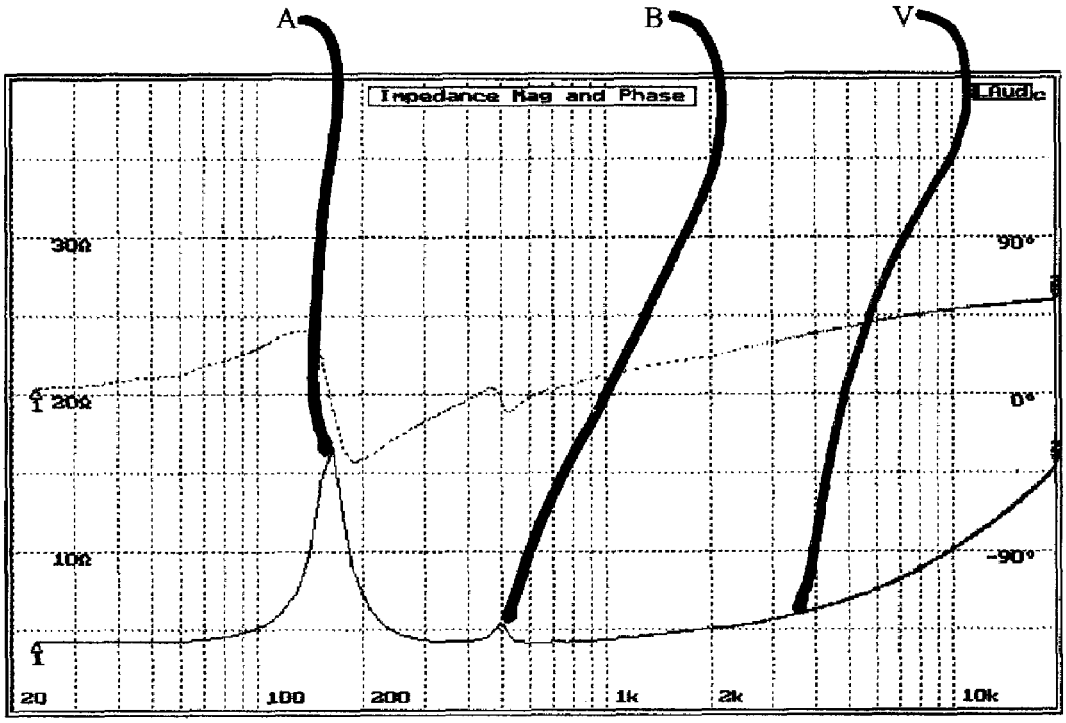
Fig. 12B

Fig. 12 C
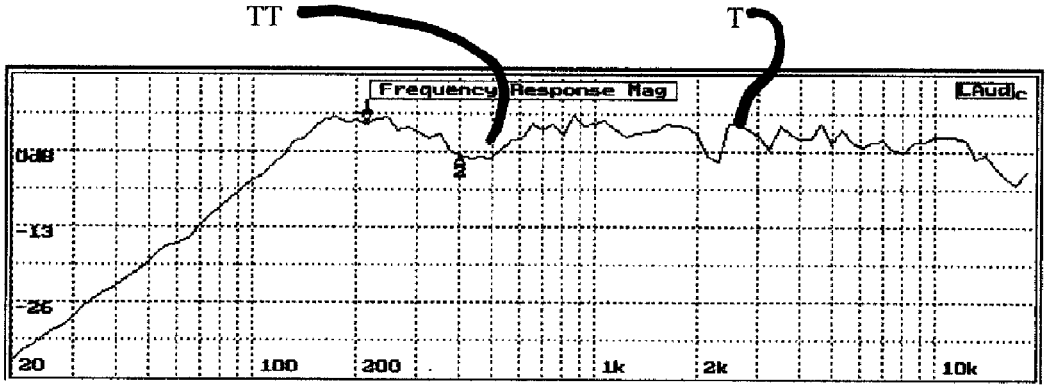
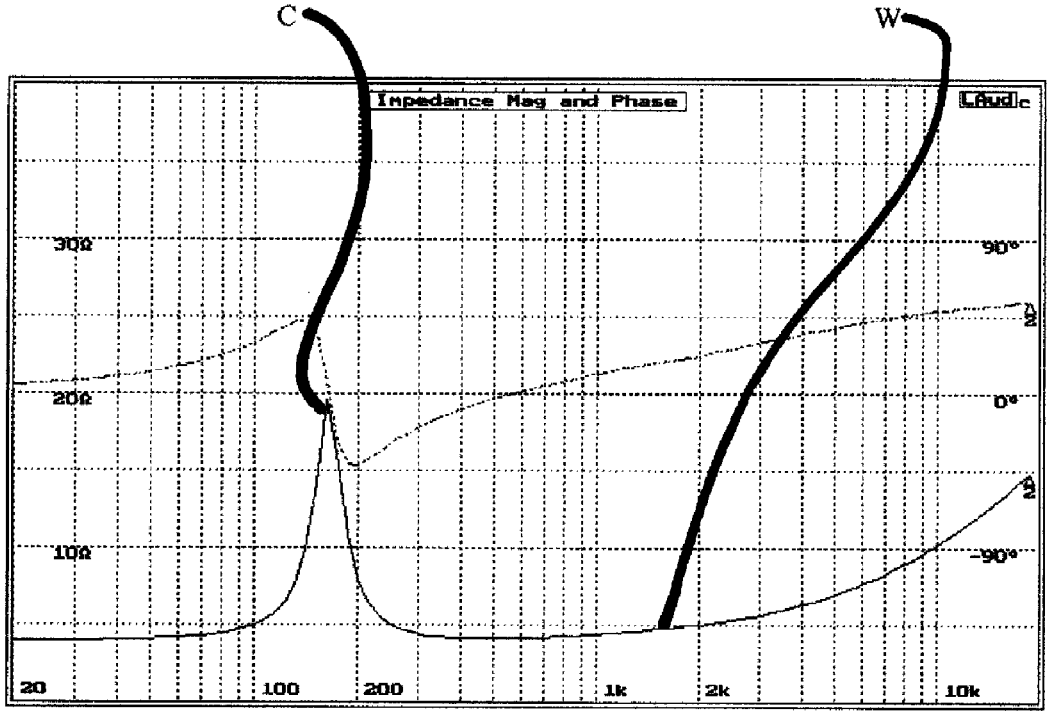
Fig. 12D

Fig. 13A
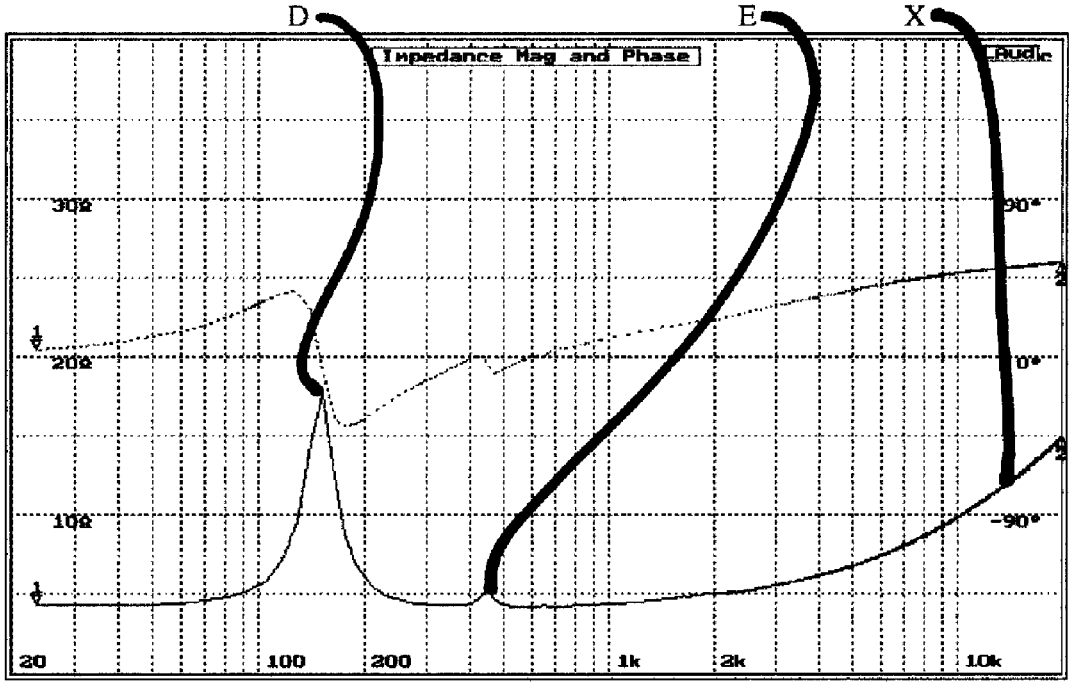
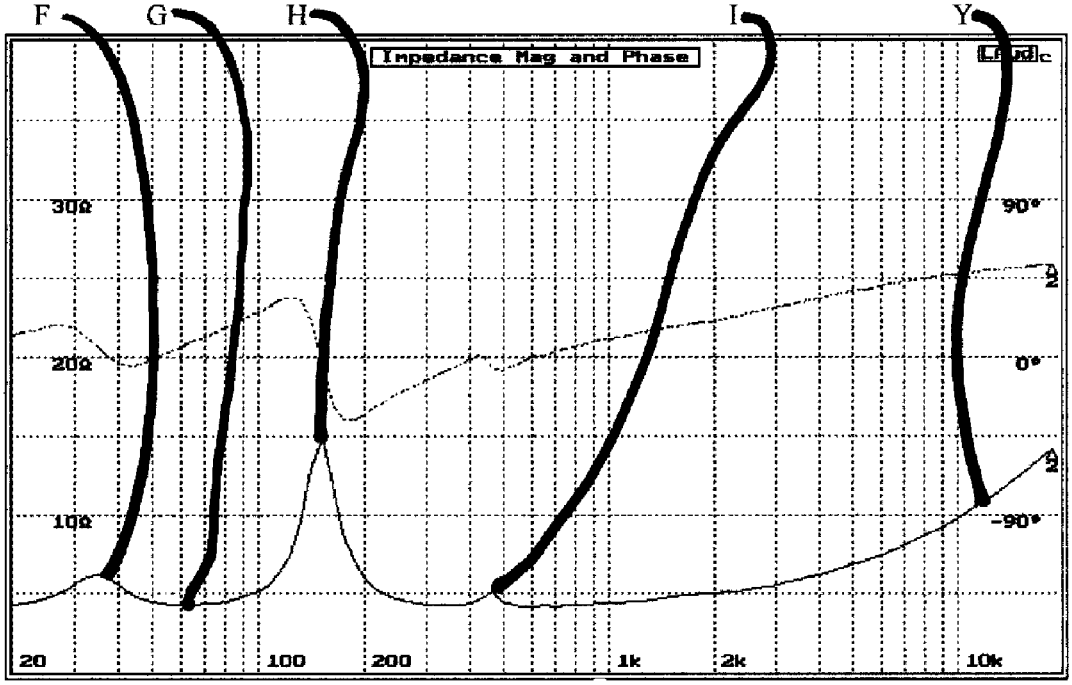
FIG. 13B

Fig. 13C
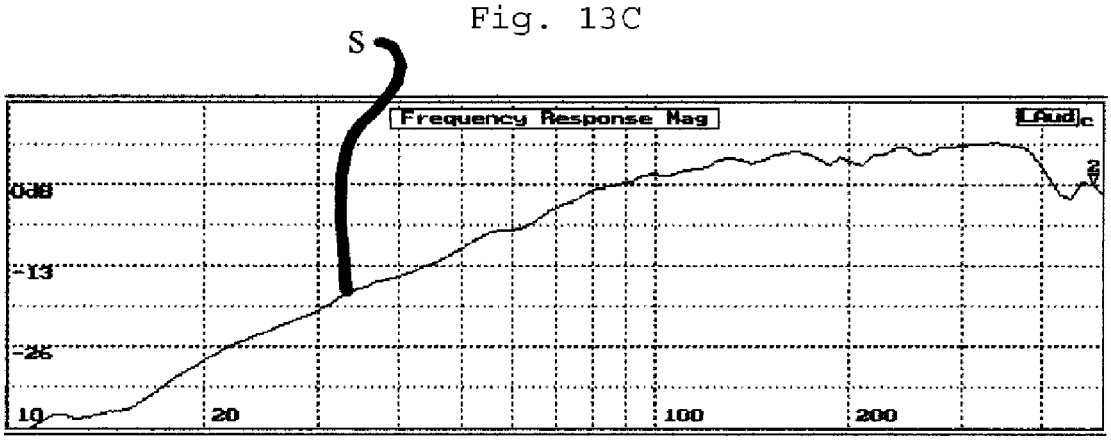
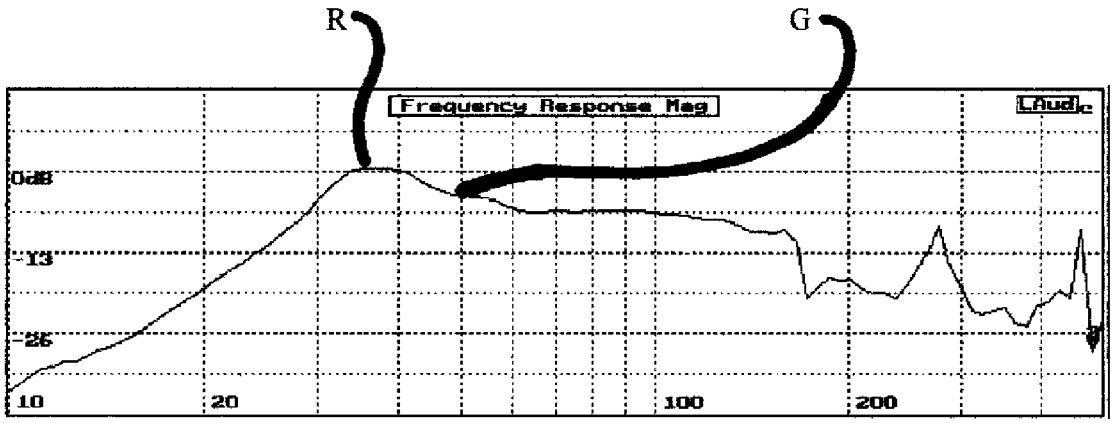
Fig. 13D

Fig, 14A

Fig. 14B
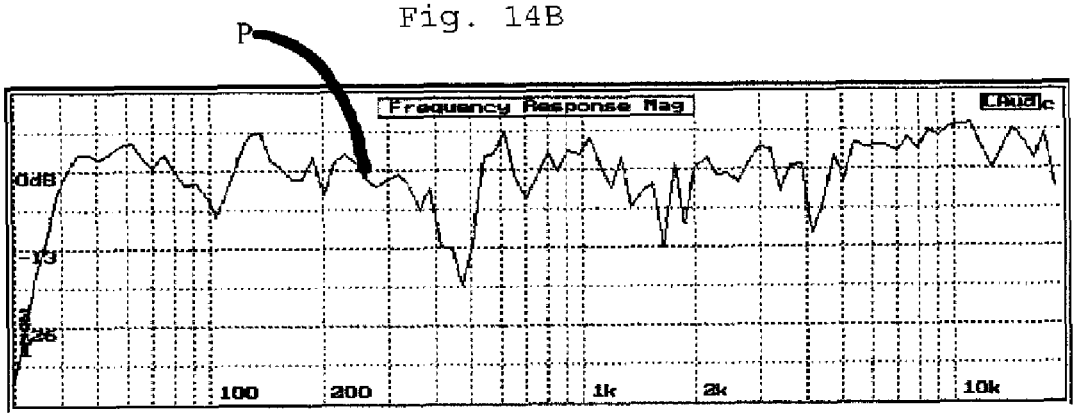
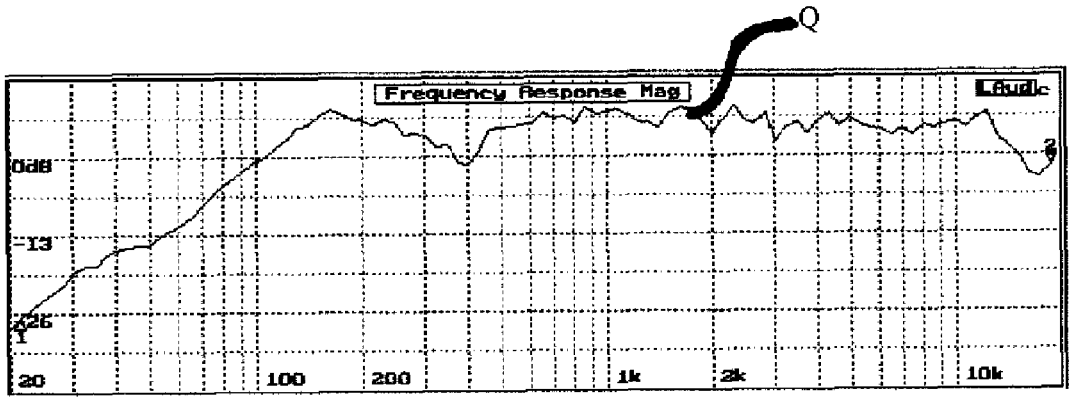
Fig. 14E

SOUND ENHANCEMENT MODULE

CROSS-REFERENCE TO RELATED APPLICATIONS

This utility patent application is a continuation-in-part of U.S. patent application Ser. No. 11/683,845 filed on Mar. 8, 2007, which is a continuation of U.S. patent application Ser. No 10/709,538 filed as U.S Pat. No 7,207,413 filed on May 12, 2004, which are incorporated by reference herein.

BACKGROUND OF THE INVENTION

A typical loudspeaker is an electro-dynamic transducer attached to a diaphragm of some depth, diameter and shape. Electro-dynamic describes a transducer that moves back and forth in response to an alternating voltage source to stimulate adjacent air molecules. Some of these types of loudspeakers may be considered a commodity and are inexpensive. They are typically mounted on a baffle as part of an existing product or structure; in some form of housing for practical containment or in some cases a specialized enclosure is utilized to enhance the bass performance.

One problem with these types of loudspeakers is that the driver may have a favorable acoustic impedance only over a narrow range of frequencies depending on its size. The smaller driver generally has unfavorable acoustical impedance for lower frequencies and vise versa for larger ones. The enclosure also favors a narrow range of frequencies and for other frequencies it may react violently creating a plethora of incoherent internal standing waves that modulate the diaphragm with nonsymmetrical vibration patterns. These random internal modulations disturb the natural dispersion pattern of the driver and cause electrical feedback (reactance) to the amplifying source. Brute force power and heavy gauge wiring are current attempts to minimize this problem for the amplifier and the effects on sound quality.

Another problem is the general acoustic impedance differential that exists on either side of the driver diaphragm. The diaphragm must work simultaneously in two different acoustic environments as the enclosure creates standing waves that constantly modify the drivers' acoustic impedance in most of its frequency range. Reflected waves from the room cause additional modifications of the drivers' acoustic impedance more as the frequencies go lower towards that of the rooms' dimensions. Smaller enclosures can be worse because of the even higher frequencies that are reflected internally and the lack of low frequency capabilities.

Two identical drivers will sound different due to their operating enclosure. One solution with mid-range speakers is to produce units with a solid basket behind the diaphragm. This may prevent random standing waves from interfering with the other drivers but it may create extreme backpressure for the range of frequencies produced by the midrange driver. This causes the driver to see a distinct acoustic impedance differential throughout its operating range thereby preventing it from producing a natural sound.

Loudspeaker driver dimensions favor a certain range of frequencies thus making a single size for all frequencies difficult if wide axis listening is desired. It is a design goal to produce loudspeakers of the smallest dimensions necessary at minimum cost while maintaining the proper loudness level while retaining the sonic presentation of full frequency range, low distortion and wide-constant dispersion. A solution is the use of multiple drivers operating for a common acoustic purpose. This is reflected in current loudspeaker designs in an effort to produce subjectively accepted loudspeakers.

When a single driver is used, it is typically designed to favor lower or higher end frequencies while attempting to maintain quality in the middle ranges. The human ear tends to be more sensitive to the higher frequencies but the human ear-brain combination prefers to hear all of the frequencies in the spectrum without phase or frequency aberrations to interrupt the flow of energy of the event otherwise it will appear to be artificial. The reproduction of sound is typically for either of two purposes and that is communication and entertainment. The latter requires unencumbered sonic balance and dispersion to balance the energy in the listening environment.

The continued efforts to perfect sound reproduction with predictable field results depend greatly on a solution to solve the dilemma of the enclosure. Engineers recognize the drivers' enclosure as a design challenge. The use of the apparatus as explained in the pending application can improve sound quality.

SUMMARY

Application of the device improves the reproduction of audio frequencies. In particular, the proposed invention relates to loudspeakers and in particular methods of improving the quality of reproduction for very low, low, middle and higher frequencies, reducing the relative enclosure dimensions, reducing the costs and dependency on the acoustics of a particular physical location for consistent results.

In one general aspect, a sound enhancement module includes a set of walls that define an enclosed chamber, an aperture in one of the walls to provide a path for audio waves to travel between the enclosed chamber and an external space and an alternative density transmission medium positioned in the enclosed chamber.

Embodiments may include one or more of the following features. For example, a disc may be positioned near the aperture. The disc may be made of metal and it may have a circular opening that is positioned coaxial to the aperture. A shelf may surround the aperture and the disc may be positioned in the shelf with an outer surface of the disc flush with an outer surface one of the module walls.

The module walls may include a set of six walls configured as a rectangular box. The walls may be made of a composite wood material.

As another feature, the enclosed chamber may have a cylindrical shape. The alternative density transmission medium in the chamber may be open cell foam.

In still another general aspect, a sound enhancement module includes walls defining an enclosed chamber, an aperture in one of the walls to provide a path for audio waves to travel between the enclosed chamber and an external space, a shelf surrounding the aperture, a disc positioned on the shelf such that a circular opening of the disc is coaxially positioned relative to the aperture and an alternative density transmission medium positioned in the enclosed chamber.

Embodiments may include one or more of the above or following features. For example, the module may have a front wall and a back wall. The front wall includes the shelf, the aperture and the enclosed chamber and the back wall is a rectangular panel that attaches to the front wall. In another embodiment, the shelf and aperture are first and second circular bores in the front wall.

In still another general aspect, a method of improving the sound quality from a speaker system with a sound enhancement module with features described above includes retrofitting the speaker system with the sound enhancement module.

Embodiments may include one or more of the following operations. For example, retrofitting may include removing a wall of a speaker cabinet, fixing the sound enhancement module to the inside of the speaker cabinet and reattaching the wall of the speaker cabinet. The center of the aperture may be positioned along a central axis of a speaker in the speaker cabinet. As another example, the sound enhancement module may be positioned behind a speaker attached to a front wall of the speaker cabinet. As still a further feature, the sound enhancement module may be fixed to a rear wall of the speaker cabinet.

BRIEF DESCRIPTION OF THE DRAWINGS

FIGS. 12A, 12B, 12C and 12D are graphical representations of performance characteristics.

FIGS. 13A, 13B, 13C, and 13D are graphical representations of performance characteristics.

FIGS. 14A, 14B, 14C, 14D and 14E are graphical representations of performance characteristics.

DETAILED DESCRIPTION

Throughout this document there will be references to particular items, figures, names, phrases and notable words. The items will appear written once with a bold capital introductory letter and then abbreviated in the bold letters representing the name in text following. The capitalized bold first letter and abbreviation may appear subsequently to refresh the memory. Certain terms that may also have an importance in this document but are not pertaining directly to a feature of the document and will not be highlighted or underscored in this mode.

Figure 1:
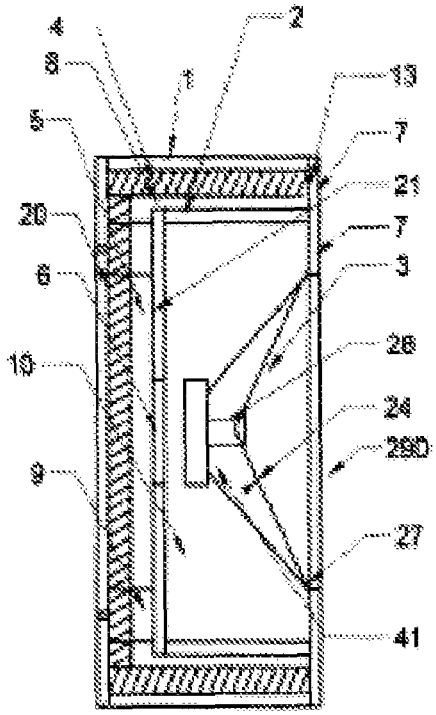
FIGS. 1A and 1B are side and front cross section views of a speaker enclosure in accordance with this invention.
Figure 1:
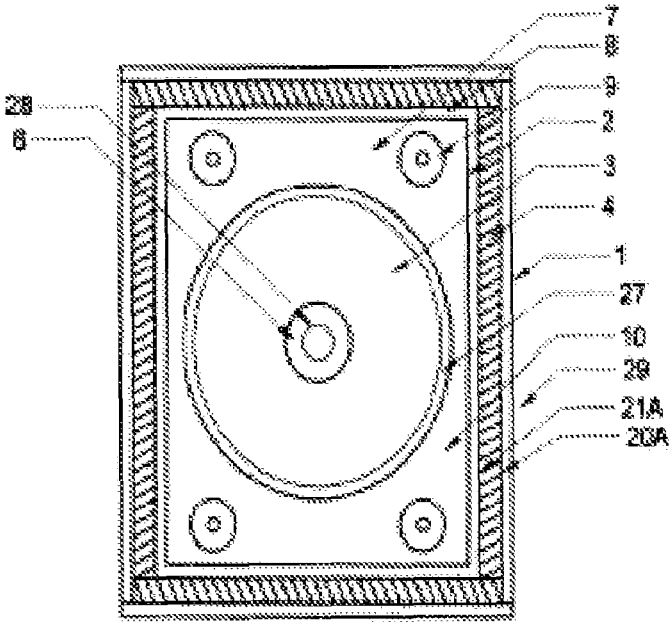

FIG. 1 represents an embodiment of the invention. FIG. 1A and FIG. 1B represent a complete Direct Radiator Enclosure (DRE) 29D speaker assembly constructed according to this invention. Bernoulli's theorem for the flow of liquid plainly states that a pressure differential must exist for a fluid to flow from a container through a discharge opening into a pressure region the same as that of the container. This means that if a sound (a fluid) of high quality is to be produced by a loudspeaker that a pressure differential must exist between its diaphragm and the atmospheric pressure and it must be consistent for all frequencies and acoustic conditions. All drivers of concern with this invention are bi-directional meaning that they radiate sound from both sides of the diaphragm. One side of the Driver Diaphragm (DD) 3 must be dynamically isolated from the Atmospheric Pressure at all frequencies within its range without concern for reflections from within or external. Dynamic isolation refers to isolation from atmospheric pressure when in motion not static isolation.

FIG. 1A illustrates a side cross sectional view of the DRE 29 enclosure with the Indirect coupled (IDC) Embedded Acoustic Transmission Line (EATL 5) structured to receive air pressure through its throat/mouth 6 behind the driver 41 mounted on baffle board 7 but buffered by the air chamber 10 of FIG. 1A. The EATL 5 unlike conventional trans-mission lines has its throat and mouth at the same point through superposition. IDC means that the wave that enters the EATL5 does so through an air chamber 10 of some relative volume so its influence on the DD 3 will be indirect yet influential. The EATL5 is constructed of the wave-guide 20 of the outer cabinet 1 and the wave-guide 21 of the Inner enclosure 2 separated by spacers 9. The EATL5 can be extended by using the side cabinet walls wave-guide 21 that are inherent in construction of the inner box in conjunction with extensions of wave-guide 20. These extensions of the EATL5 are 20A and 21A and will allow the EATL5 to operate to a lower frequency than the 20 and 21 alone but are generally relative to driver 41 size.

The EATL5 is sealed by the termination member 13 that contains the wave at one end of the EATL5 reverses it and creates Dynamic Standing Waves (DSW) at the throat/mouth 6 located in the center (from each corner) as seen in FIG. 1B. The term throat/mouth defining 6 results from the reflected wave having its point of exit at the same point as the waves point of entry. The fact that the in/out waves can be superimposed on each other accounts for this unique pressure feedback principle. The air volume within the EATL5 is always small relative to the operating volume of chamber 10 of FIG. 1 or 19 of FIG. 6 and is not a closed band-pass box. The overall dimensions may be further reduced using miniature construction techniques to enhance the output of smaller drivers in small spaces as well as OEM tweeter construction where the rear wave will be collected and returned as beneficial standing waves. The spacing dimensions can be reduced or increased as needed and the EATL5 may be repeatedly folded to increase its length as needed if 20A and 21A are not adequate in length.

The EATL5 is lined with an Alternate Density Transmission Medium (ADTM4), which in the embodiment is open cell urethane foam that under normal air density and higher frequencies is inert, randomly accepting new air particles, yet at lower frequencies when pressurized allows additional air molecules to expand to within its cell structure in search of volume but instead are lost in heat dissipation. This is a lossy process hence the DSW and damping of the Driver Resonance Peak (DRP) as shown in FIG. 10A vs. FIG. 10B whereas FIG. 10A is the curve of the embodiment. Damping is a term referring to ability of a vibrating body to cease motion immediately when stimulus is removed.

Figure 2:
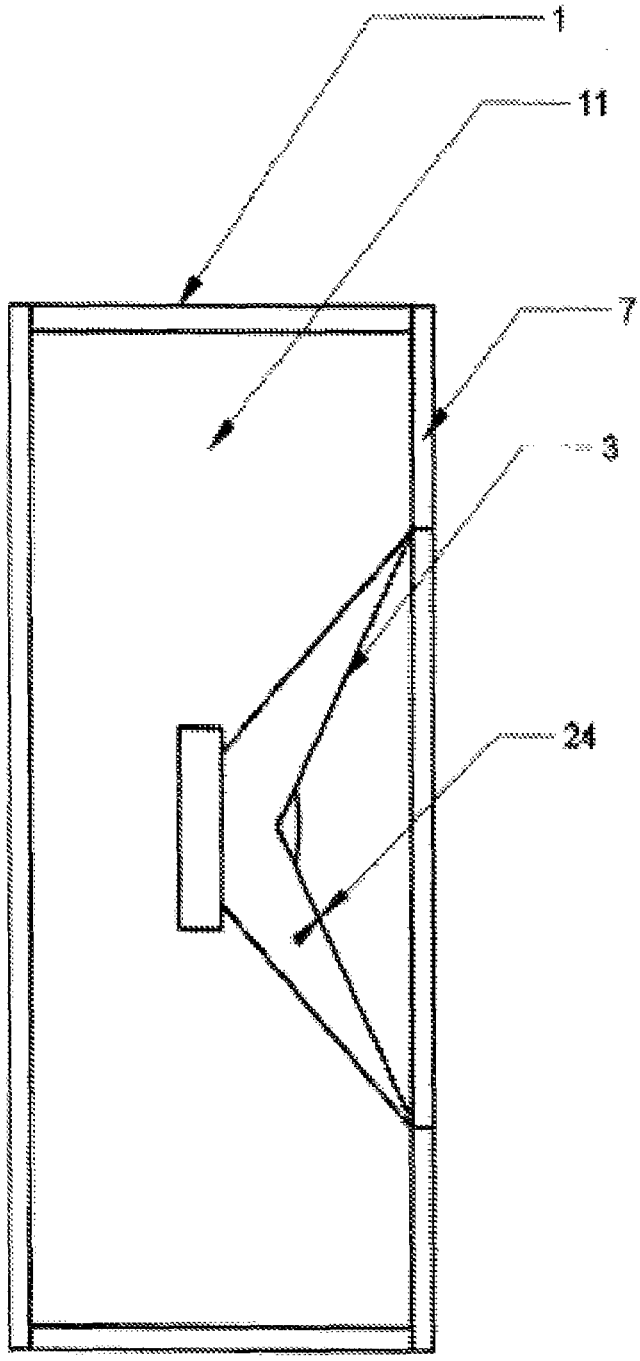
FIG. 2 is a cross section view of a speaker enclosure without the EATL features.

A relatively high frequency wave entering the throat/mouth 6 of the EATL5 has only to be within inches of the driver diaphragm 3 to reach its wavelength in normal air density. The enclosure in FIG. 2 is only a few inches deep meaning that any wave below 10 kHz would experience enclosure reflections almost immediately. FIG. 2 represents an enclosure of air volume 11 with identical dimensions as that of FIG. 1 but without 2 and 4 of that structure.

The waves traveling the stream lines 15 will enter the mouth 6 of the EATL5 and travel through the EATL5 barely interacting with the surface cells of the ADTM4 expanding almost immediately until it reaches the termination point 13, which then reflects the wave back toward the driver diaphragm 3. The throat/mouth 6 at the entrance of the EATL5 will experience nodes and anti-nodes (DSW), which overlap and influence the pressure in chamber 10 behind the driver 41 and are considered a positive pressure relative to the atmosphere.

As the frequencies go lower from that first influenced, the EATL5 will maintain a constant positive pressure on the driver diaphragm 3 due to the DSW condition of the air space 8 and the DSW condition caused by depth migration indicated by streamlines 14. As varying wavelengths/intensities occupy deeper depths of the ADTM4 cell structure they create individual DSW and therefore dynamically enhance motion of the driver diaphragm 3. The individual DSW produced will integrate their pressures and produce a composite DSW in the presence of multiple frequencies simultaneously (superposition).

Wave-guides 20, 21 must remain within a close spacing so as to contain the wave energy while directing it to the termination member 13. In the example, 20, 20A, 21, 21A are at 12 mm and 9 mm spacing respectively and will vary somewhat depending on driver diameter and purpose for system. The driver 41 will see these DSW influence its acoustic impedance because the pressure-differential with that of the atmosphere is maintained with frequency. The DSW are the result of changing frequencies, driver compliance and resistance by the ADTM4 material to the sound energy entering its cells.

The resulting interaction of the three variables maintains the chamber 10 pressure constant as the frequency changes while the drivers velocity remains linear. Internal pressure at chamber 10 would be a composite DSW resulting from the voice coil 28 signal input and the initial motion of the DD 3, the static pressure of 10 and the positive pressure created in the EATL5. This resultant composite pressure is constant and is relative to intensity and wavelength in the EATL5 and determines DD 3 motions.

The length of the EATL5 is directly associated with its low frequency limit of influence as is clearly indicated by the curves of FIGS. 12B and 13A. In FIG. 12B the impedance plot of the speaker system of FIG. 1 is indicated. There are two peaks associated with this impedance plot; the large one A is the DRP that occurs at 150 Hz and the other peak B that occurs at 500 Hz represents the EATL 5 ¼ wave impedance peak of FIG. 1. FIG. 13A represents the frequency response if the enclosure of FIG. 1 is lengthened by 2 cm to become the enclosure FIG. 3. The 2 cm increase in enclosure depth 26 FIG. 3 can be interpreted in FIG. 13A by the new EATL 5 peak E at 400 Hz to cause a 100 Hz shift downward in ¼ wave frequency at the EATL5 throat/mouth for processing into DSW.

Figure 3:
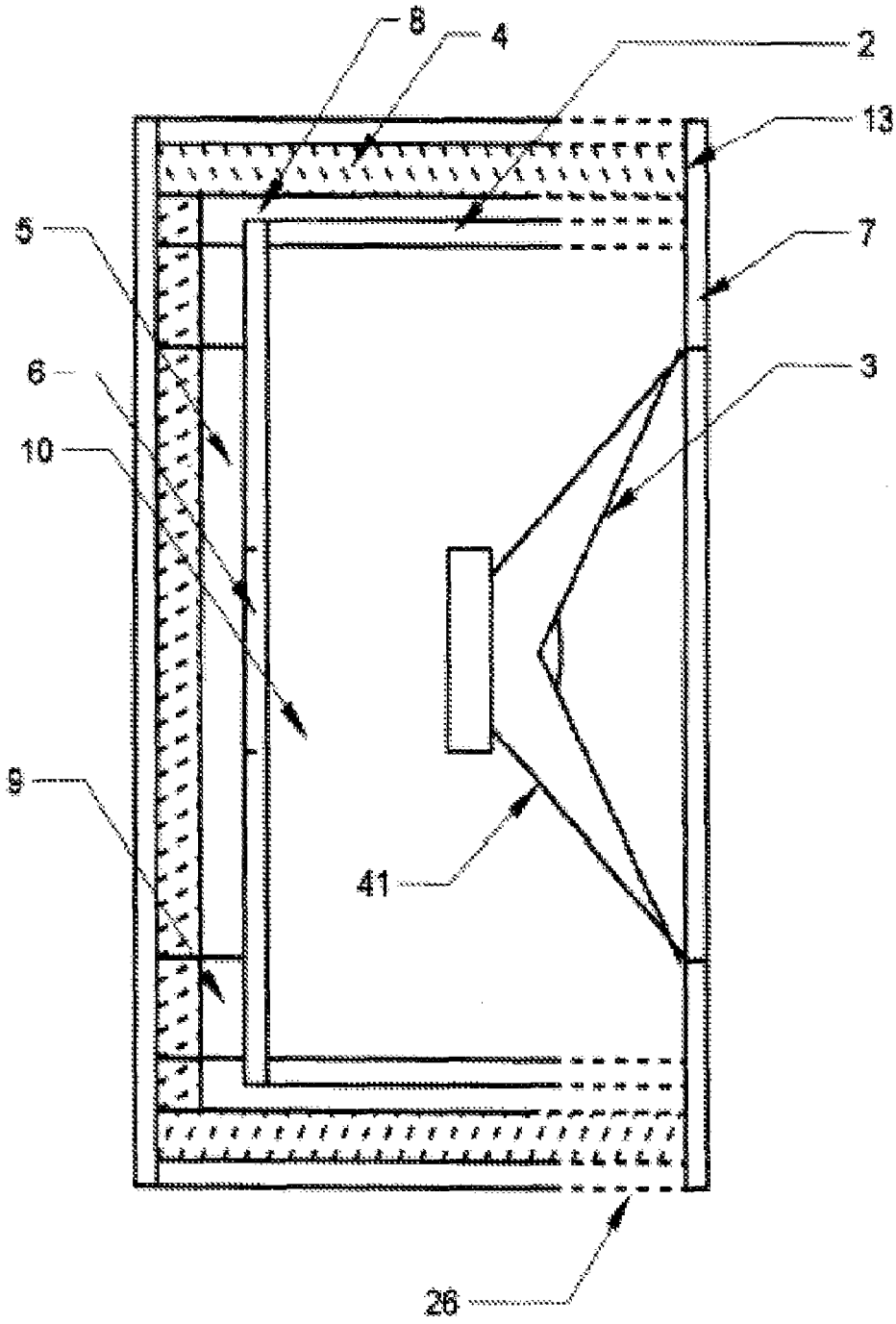
FIG. 3 is a cross section view of a speaker enclosure.

The main driver resonance frequency of FIG. 3 does not change appreciably when chamber 10 is increased as seen in 40 FIG. 13A. It can also be seen in the frequency response plot Q of FIG. 14E of FIG. 3 to show the lifting of output to begin at 400 Hz instead of the 500 Hz of the shallow enclosure of FIG. 1. A large peak C can be seen in FIG. 12D (which is the standard closed type enclosure FIG. 2 with the same driver) but without a properly damped (controlled) impedance peak A or an EATL 5 peak Bas FIG. 1 or FIG. 3. The change in volume 10 did little to affect the drivers' resonance frequency A of the driver 41, which indicates the effectiveness of the EATL5 in delaying the wave in such a short distance. The damping of the DD 3 improves acoustic impedance for bass frequencies lessening cut-off slope for deeper bass extension and better overall transient performance. The 500 Hz EATL5 peak B of FIG. 12B represents the lowest frequency that will be lifted by the EATL5 of FIG. 1 to correct the sagging output (FIG. 12A vs. 12C) of the DD3 that normally occurs above the driver resonance frequency A and the point in which the EATL5 will begin to dampen oscillatory conditions near, at and below the drivers' resonance frequency A FIG. 12B.

The impedance curve FIG. 12D of FIG. 2 shows the same location for the drivers' resonance frequency C as that of FIG. 12B of FIG. 1 and FIG. 13A of FIG. 3. The curve in FIG. 12D, clearly shows this peak C occurring at 150 Hz and if followed closely above this point shows no EATL5 peak B as in FIG. 12B, FIG. 13A and FIG. 13B. If the curve U of FIG. 12A of FIG. 1 is observed it will show an increase in output beginning at 500 Hz or the same point as the EATL5 peak B of FIG. 12B. All frequencies above this peak will show an increase in output developing a gain to increase and maintain a flat response. The gain in efficiency averages 6 db for this particular example when averaging several points from 500 Hz and above. The only way for this to occur is for a constant pressure from within the enclosure to maintain the proper DD3 velocity as frequency changes. This process does not change the specifics of a driver 41 sound signature only the effects mass and random internal standing waves have on its operation. The frequency peak UU, @500 Hz FIG. 12A of FIG. 1 does not exist in the graph FIG. 12C of FIG. 2 nor does the increase at 10 kHz. At point TT@500 Hz FIG. 12C there is a dip and only a small insignificant peak then falling response.

A vibrating body will experience its greatest motion at resonance with less movement above and below that frequency for the same stimuli. The output (motion) falls much faster below resonance because of compliance while above it falls at a slower rate due to mass. The loss of output above resonance is directly related to mass (as it is affects the acceleration of the DD 3 as needed at higher frequencies) while the DSW in the EATL5 are directly related to frequency and increase pressure to counter the loss and maintain pressure constant (DD 3 in motion). The DSW generated internally at the mouth of the EATL5 provides positive pressure in real time buffered through volume of chamber 10 as each frequency may require in a composite wave maintaining maximum signal transfer relative to atmospheric pressure. The random standing waves existing in the enclosure of FIG. 2 disturb the dispersion pattern by producing random pressures on various parts of the DD3 to generate noisy sound.

It is difficult to determine parameters for certain products since the effects of field usage are hard to predict. Specifications developed to predict the vibration characteristics and dispersion of any given driver diameter are not useful if the enclosures SW are allowed to affect the DD 3 radiation pattern. This is one of the main reasons that engineers seek various types of suspension 27 and DD 3 materials as a solution to resist DD 3 breakup caused by these unknown sources. These breakup patterns are caused by random standing waves, which are dynamic and linked to the enclosure 1, amplifying source and signal. Random standing waves must be transformed into beneficial ones not resisted as in existing enclosure design if a neutral expression of a driver is to be observed. The elimination of random internal standing waves and the production of useful coherent ones allow the driver 41 to operate as specifications describe for the materials, diameter and construction.

A further result of this acoustically derived internal positive pressure is to further reduce diaphragm breakup as the pressure is applied to the entire surface to reduce the effects of solid transfer breakup modes. These are breakup modes that are generated when the voice coil 28 is stimulated.

Initial stimulation at 28 results in DD3 motions, flexing of all materials and a physical transfer of acoustical-mechanical energy towards the edges of the DD 3 as waves. At the outer edges of the DD 3 exist some type of flexible material 27 that surrounds and anchors the diaphragm to allow general motion of the entire moving assembly when the voice coil 28 stimulates it.

It is desired to have the energy that travels these paths dissipate in the diaphragm material and as kinetic energy into the surround material 27 and that does occur in most cases. The diaphragm and surrounding material 27 do not absorb all frequencies and some are reflected back toward the center or point of origin. In doing so waves, coherent and non-coherent, physically collide in the DD 3 material causing regions of positive and negative standing waves to exist on the DD3 surface that alter the dispersion pattern. These types of patterns can be observed and countered during engineering design phases and perhaps will result in a better driver 41. The EATL5 will minimize audibility of these types of breakup modes but not eliminate them.

Figure 4:
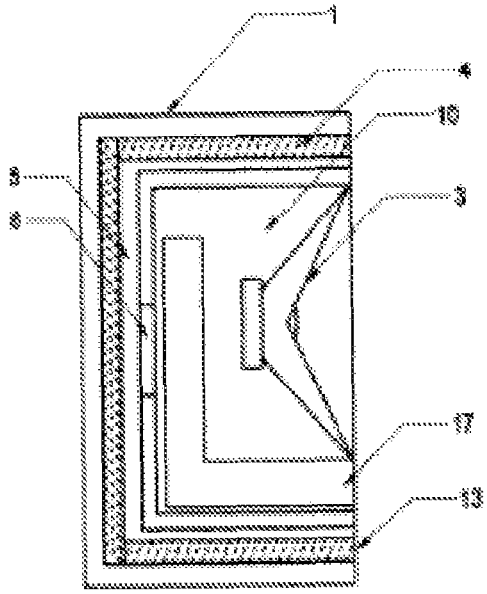
FIGS. 4A and 4B are cross section front and side views of the speaker enclosure with a reflex port added.
Figure 4:
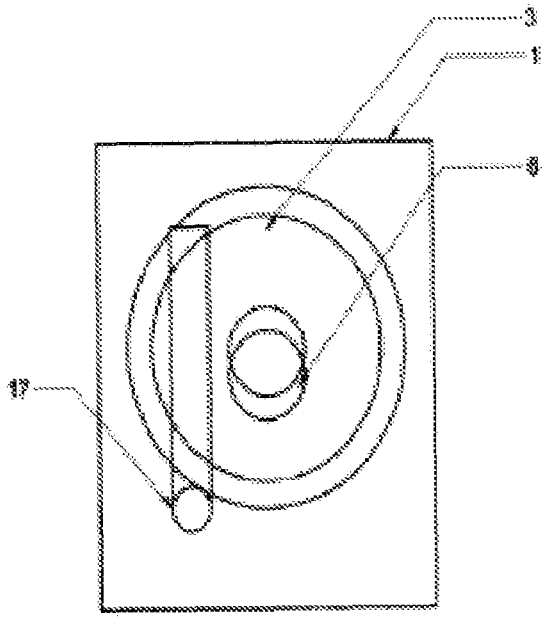

FIG. 4 represents the enclosure of FIG. 1 or FIG. 3 with the inclusion of a port 17 to enhance bass frequencies. The addition of a port 17 does not affect the DSW at the throat/mouth 6 and the maintenance of acceleration of higher frequencies by the EATL5 whose primary purpose in this embodiment is to counter the mass that results in signal loss above the resonance frequency of the driver 41. The EATL5 provides critical damping for the DD3 to improve stability at lower frequencies as indicated in FIG. 12B of FIG. 1 and FIG. 12D of FIG. 2. These impedance plots indicate that the resonance frequency remains near the same for both enclosures however the peak A of FIG. 12B indicates proper damping of the DD3 (as a controlled peak ratio is achieved for a smooth extended bass response and character) whereas the impedance plot of FIG. 12D indicates that the driver 41 has a high sharp resonance peak C (to indicate a sharp loose resonate sound).

This highly damped condition is maintained in FIG. 13B of FIG. 4 with a port 17 included to extend the response of bass. The impedance plot FIG. 13B has three distinguished peaks with the port peak F and saddle G (box resonance frequency) before the driver resonance peak H indicating reflex operation is occurring with a well-damped driver 41 that is simultaneously having its upper frequencies lifted beginning at 400 Hz. When compared with the driver in FIG. 2 with the impedance curve FIG. 12D the driver 41 of FIG. 4 has three peaks FIG. 13B indicating an increase in output both above and below the driver resonance peak H due to controlled resonance.

In observing the frequency location of the peak I caused by the EATL5 positive pressures it can clearly be seen that the ported enclosure of FIG. 4 is the 9 mm enclosure discussed earlier with a 400 Hz peak position on the graph. This peak H and EATL5 peak I of impedance curve FIG. 12 at 400 Hz remained in the same position indicating a well loaded speaker system that has enhanced (properly damped and extended) lower frequencies and (properly accelerated) upper frequencies.

Figure 10:
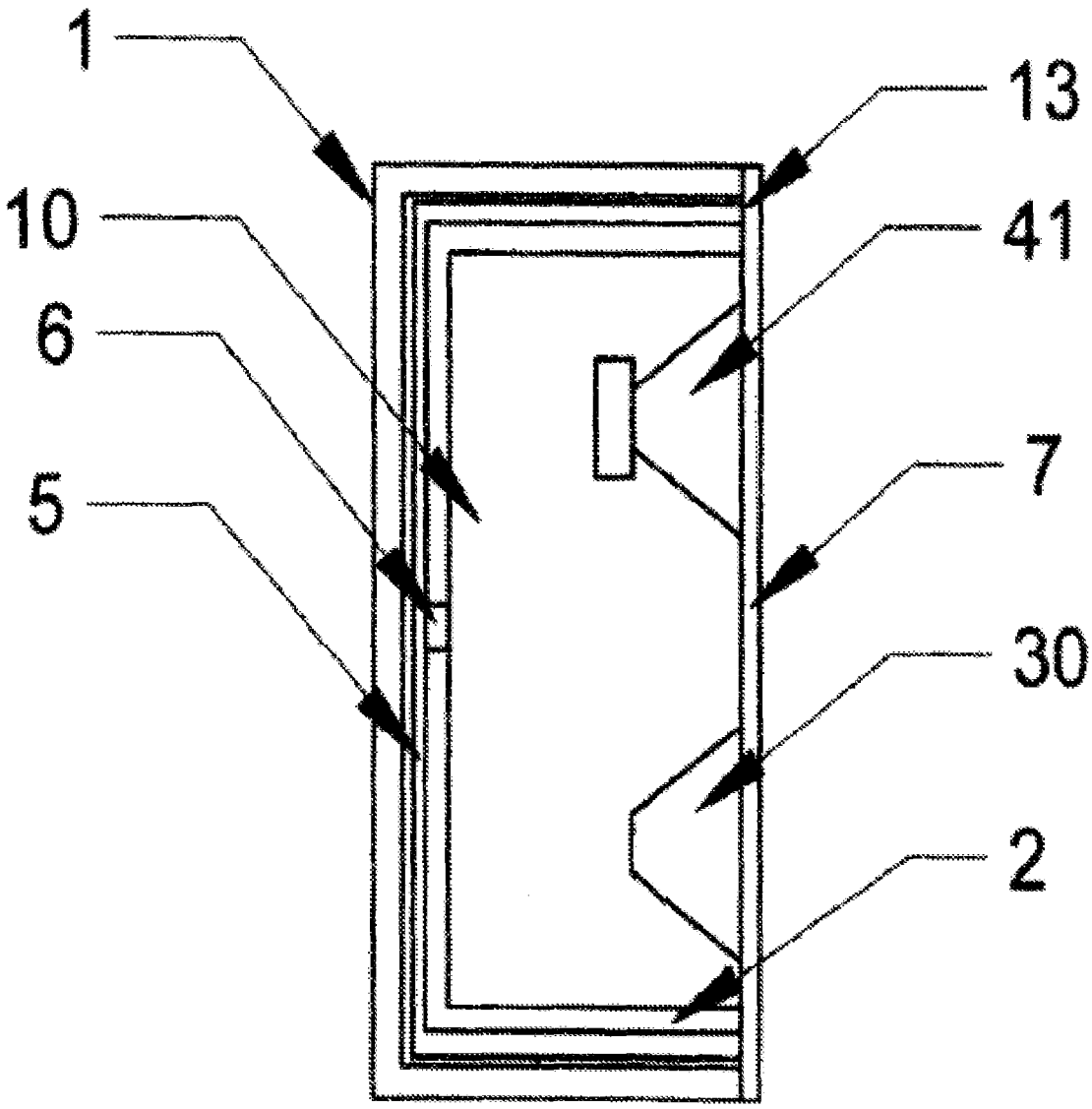
FIG. 10 is a side cross-sectional view of the speaker system of FIG. 1 wherein the port has been replaced with a passive radiator mounted on the baffle board with the driver.

Shown in FIG. 10 is a simple illustration using a suitable passive radiator 30 substituted for the port to work in conjunction with the driver 41 to extended the bass to lower frequencies. The use of a passive radiator 30 would maintain the sealed condition of the acoustic system however all configurations would not benefit from this type of resonate system. Passive radiators 30 generally require more mounting area and would be suitable for larger systems with more available baffle board 7 area. The passive radiator 30 EATL5 configuration would maintain the same general characteristics as the ported system if it is aligned properly and have a curve similar to that of FIG. 13B.

Figure 11:
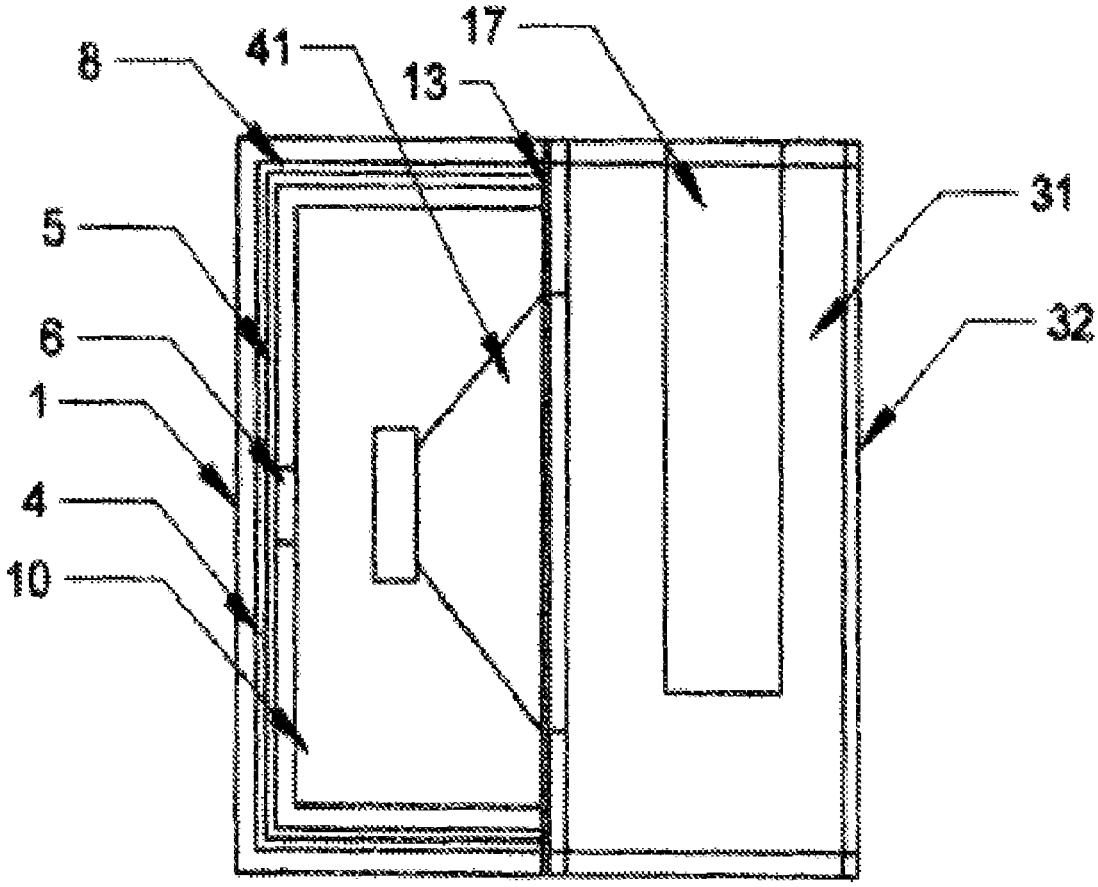
FIG. 11 illustrates a band-pass mode of operation of the system of FIG. 1 showing an acoustic low pass filter coupled to the front of the driver using a port to radiate the sound.

Another alignment for the DRE29I is that of coupling the front of the driver 41 to an acoustic low pass filter as in FIG. 11. A port 17 or passive radiator 30 is capable of acting as an acoustic low pass filter in conjunction with air mass 31. Here the EATL5 provides for constant pressure loading, damping and enhanced upper bass output and control while the port 17 establishes box loading with air volume 31 reducing DD 3 excursion allowing for a sealed air chamber 10 and better damping. The design will have three impedance peaks as that of the other ported EATL 5 designs one ahead and behind the DRF.

As in the earlier example, a passive radiator 30 can exist to resonate the new air mass 31 existing in front of the driver 41 when mounted in at least one wall of the additional enclosure 32. The IDC EATL5 acts as an ideal impedance matching device for virtually any conventional type of driver and loading method. It creates two ranges of increased pressure to benefit the frequencies above and below a drivers' resonance. Frequencies above resonance can be directly radiated as for the full range or the DD3 can be loaded into an acoustic low pass filter to focus on a range of bass frequencies.

A driver will have an optimum frequency range of operation that it is most suited to reproduce. It would be very difficult if not impossible to obtain perfect operation for one driver 41 over the range of 20 Hz to 20,000 Hz especially at higher power levels. Individual EATL5 optimized enclosures DRE 29 can focus their advantages on narrow sound ranges to assist the driver in its optimal range.

This may be for the purpose of dividing the sound ranges to use optimal drivers for each range FIG. 10A 29H, 29M, 29L, 29VL using individually optimized EATL5 enclosures or it may be for the purpose of increasing the sound level in a single range FIG. 10B 29A, 29B, 29C, 29D using multiple EATL5 enclosures operating in the same frequency range or for both applications simultaneously. This type of operation is enhanced because of the positive pressure behind each driver and the resistance therefore from interfering with other diaphragms.

Conventional close spacing of drivers' results in many unpredictable effects because the random nature of the individual internal standing waves further alters the dispersion pattern. The coherent output of EATL 5 enclosures will combine in multi-way speakers to make the crossover from one driver to another smoother and more lobe free. The coherent output from grouped reinforcement drivers whether cluster or line will perform according to their intended theory. A special housing 16 can be used to adjust the DRE 29 units properly for the application.

The EATL5 can also be used in conjunction with exotic acoustic transducers (driver 41) such as with electrostatic and dynamic planar type diaphragms. Typically the flat panel loudspeakers radiate bi-directionally because of the negative effect an enclosure or close wall placement has to one side of the sensitive diaphragm. The random reflected standing waves are of even greater harm because of the large diaphragm surface area required to generate meaningful sound levels with these types.

Figure 7:
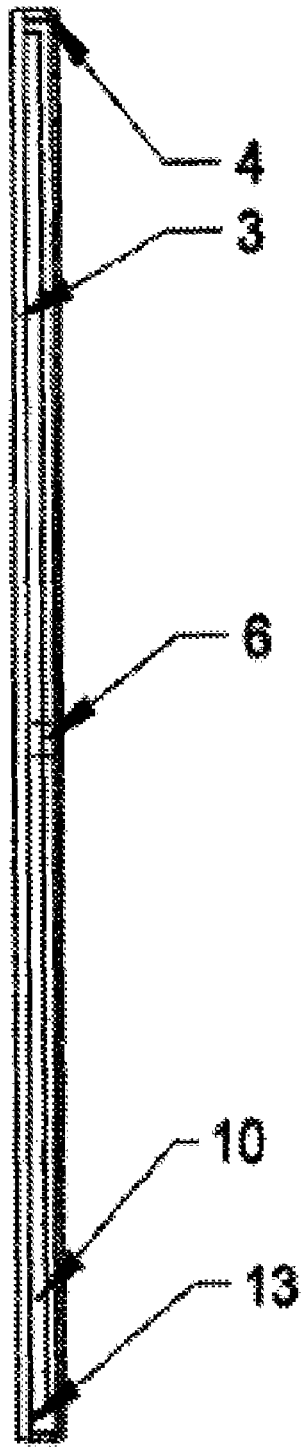
FIG. 7 is a drawing highlighting features of the EATL technology with planar speakers.

FIG. 7 is a simple illustration indicating the important reference parts for EATL5 use with these flat panel type loudspeakers. The EATL5 would consist of the same basic parts as illustrated as the dynamic driver 41 version only larger panels would be involved and adjustments of certain other parameters involved with EATL5 construction. Certain types of exotic drivers qualify and can only benefit from IDC of the EATL5 and this is the case for the planar speaker DD3 .

Figure 9:
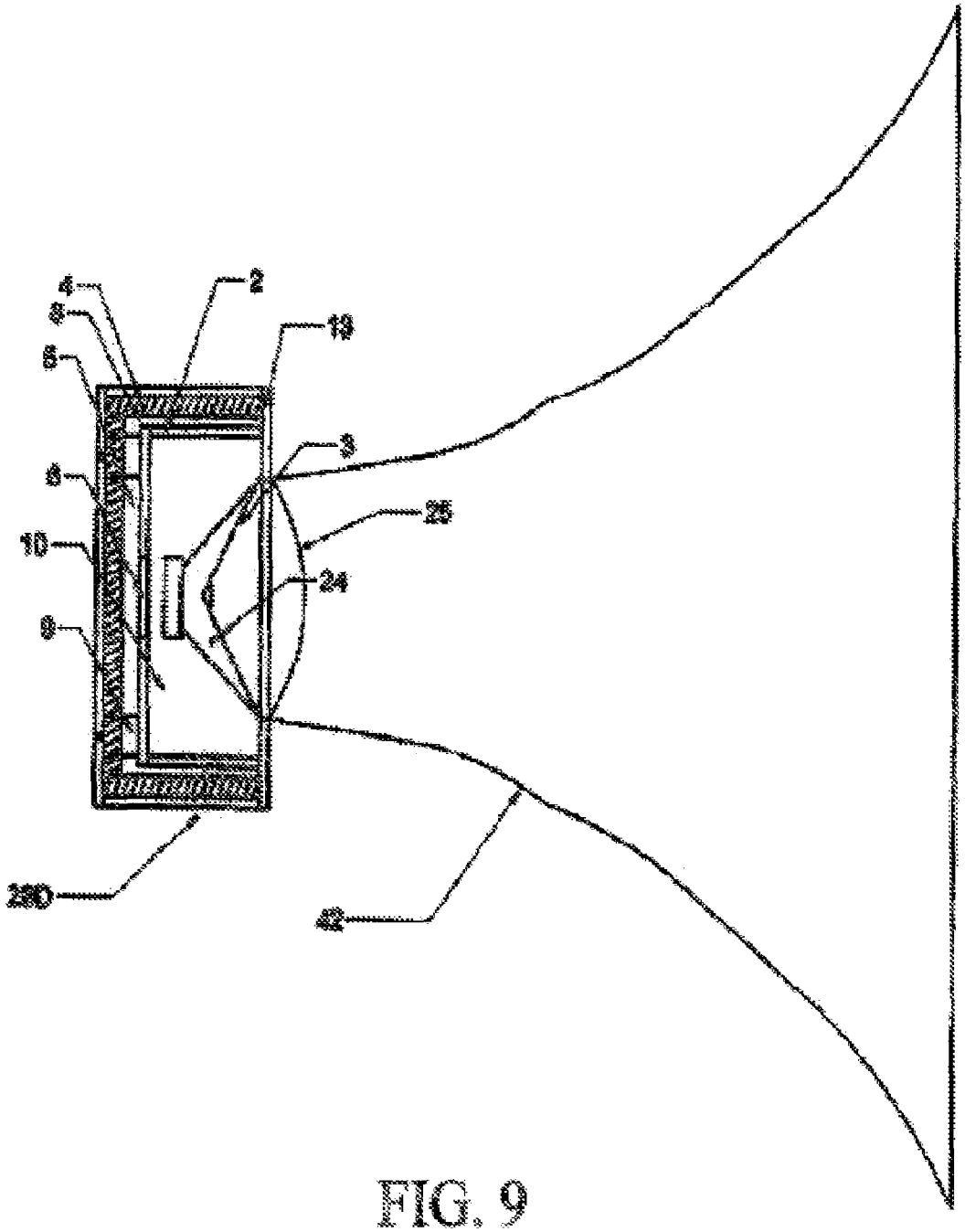
FIG. 9 illustrates the use of the EATL technology with horn coupling devices.

Illustrated in FIG. 9 is the use of a horn apparatus to IDC the EATL5 for further transmission benefit. Horns are generally used to increase the level, distance and some times coverage in a specific area while shadowing others. The close coupling of the horn extension to the unaided DD 3 of the horn produces intense reflections back into the DD 3. Typically a horn coupled driver 41 suffers chronically from breakup because these reflected features are acoustically amplified so the DD 3 suffers from competing horn bell type reflections at its surface.

A phase plug 25 may be necessary to maximize pressure transfer depending on the diaphragm type. The driver 41 operating with the positive pressure of the EATL5 assisted environment will not be as affected by these reflections producing a much clearer output from a well designed horn coupling.

Direct Coupled Low Frequency Applications

Conventional loudspeakers need large diaphragm areas and/or high mass to produce low frequencies while attaining high efficiency in the process. The current processes for bass reproduction are inherently efficient because they operate the driver at and near its resonant frequency but this is also the Achilles' heel for sound quality. Resonance is the number one enemy of a finished sound system although the parameter is involved with the execution of any speaker system. The DC EATL 5 mode of operation will allow a very small driver to produce low bass frequencies at low to moderate efficiencies. When a 3" driver is made capable of producing very low frequencies at a useful level then efficiency isn't a proper term to characterize its performance.

Figure 5:
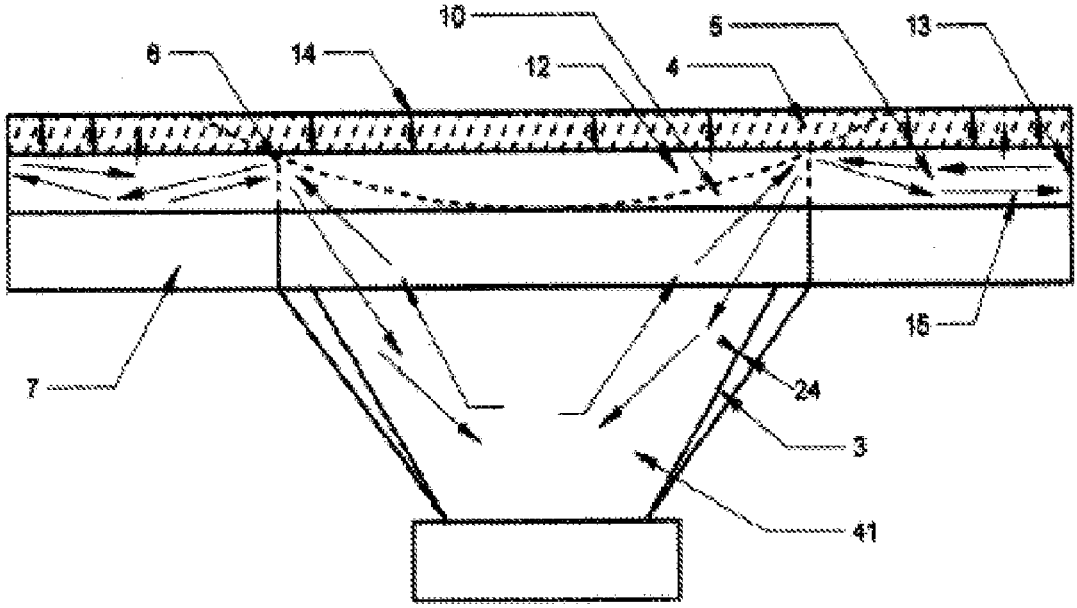
FIG. 5 is a cross section view of the Direct Coupled (DC) EATL in accordance with this invention.

FIG. 5 represents the application of the EATL5 in conjunction with a dynamic driver 41 for the purpose of generating very low frequencies only and is called the Direct Coupled DC EATL 5. The EATL construction is very similar to the IDC with the exception of a larger throat/mouth opening 6 equal to the driver diameter and compression plug 12 located immediately in front of the driver 41. The EATL 5 is Directly Coupled (DC) to the driver 41 with minimum area air volume in chamber 10 between the driver and the throat/mouth 6 of the EATL 5. The driver is mounted with front facing the EATL5 mouth 6 so as to create a high compression chamber 10 for driver loading. In this mode the driver 41 is compression loaded so a compression plug 12 is used to help direct wave motion into the EATL 5 and to minimize air turbulence at the throat/mouth 6 of the EATL5 and to establish the correct throat/mouth 6 area for the EATL5.

DC coupling places the driver 41 completely under the influence of the EATL5 and it will follow the frequency pattern it establishes. The ADTM 4 establishes delay of the waves through depth migration thus allowing a wide DSW bandwidth. The higher low frequencies above driver 41 resonance are not effected as readily by the cellular structure and will sustain constant pressure in the EATL 5 before depth migration.

Figure 14D:
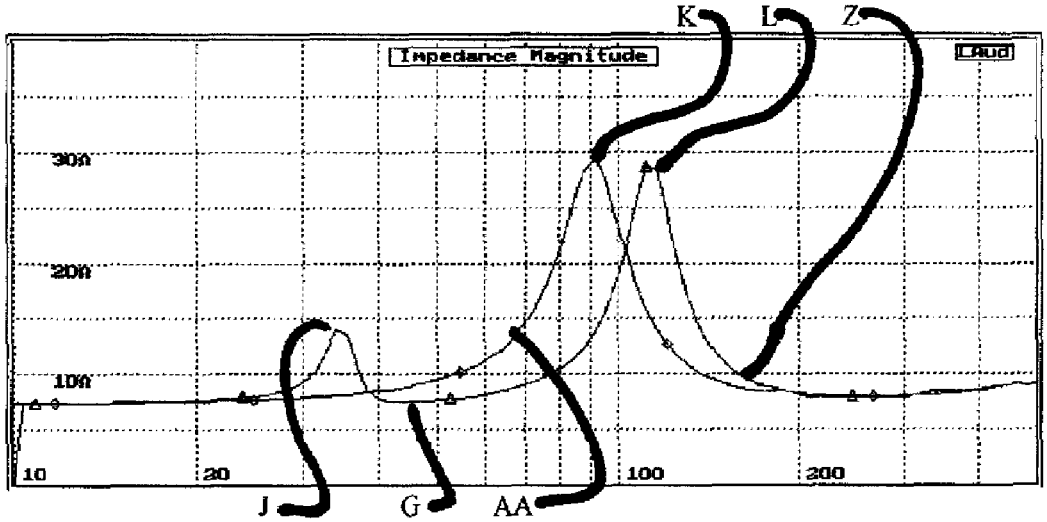
Figure 14D:
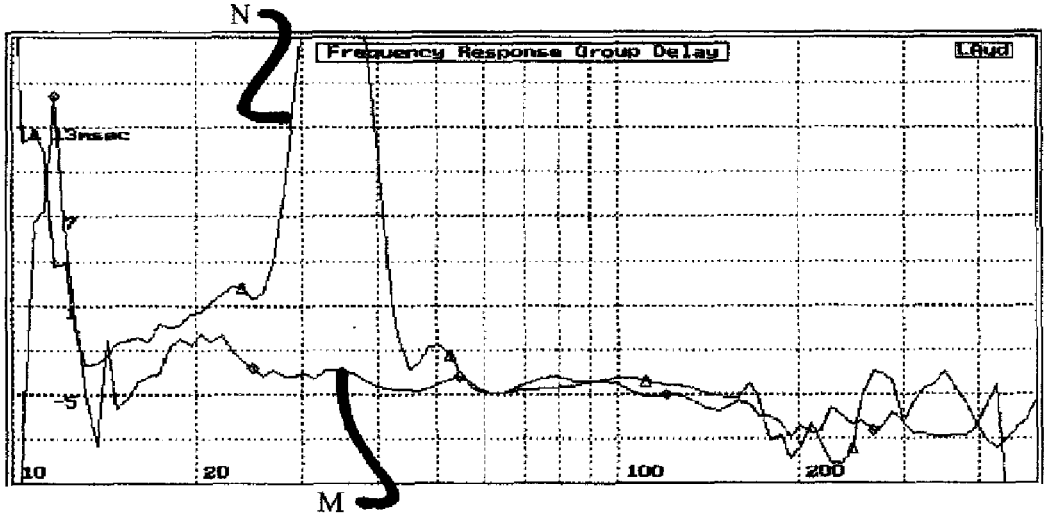

This can be seen in FIGS. 13C and 14D. The frequency response curve FIG. 13C represents the driver 41 output of a DC driver and EATL5 only and it can be seen that the frequency response shows a 12 db/oct falling output from the driver 41 resonance frequency and frequency irregularities above driver resonance. This represents a constant high positive pressure on the DD 3 relative to frequency and a dynamic pressure much greater than atmospheric pressure for all frequencies in the systems bandwidth. When measured at 100 Hz this signal at the DD3 is 40 db greater than that at the mouth of the port 17 when it is added. This output curve represents the actual output that the driver 41 will deliver with the positive pressure applied to the DD 3 from the EATL 5.

In free air a similar pattern would be generated except the 12 db/oct slope would begin at the drivers' free air resonance frequency. Under these conditions the frequency would shift if the acoustic impedance of the driver is altered. Curve S is a reference high-pressure curve with a predictable 12 db/oct rate of fall and is easy to shape with an acoustic low pass filter. This curve also reflects a predictable falling diaphragm excursion relative to lower frequencies.

A reflex enclosure would further reduce DD 3 motion in the power bass frequency range (30 Hz-60 Hz) and not have a subsonic distortion problem after the EATL5 peak. An acoustic low pass filter 18 connected to the driver 41/EATL5 in FIG. 5 would favor the lowest frequencies even though these frequencies are falling in curve S FIG. 13C. The 12 db/oct falling output of FIG. 13C are transformed into the curve R of FIG. 13D for FIG. 6 which shows 6 db/oct rising output from 70 Hz. The curve in FIG. 13C is generated with the driver 41 in high-pressure environment that will resonate the box with little effect on the constant pressure loading of the driver. The positive pressure allows the output from the rear of the driver to resonate a reflex enclosure with acoustic volume 19 at frequencies within the 12 db/oct slope. The efficiency in the range of the transformation is moderate relative to the driver mid-band efficiency yet it allows a small low mass driver to use its fast responding diaphragm to produce usable bass at frequencies determined by the EATL5.

Almost any similar diameter driver 41 may be used to generate the curves of FIG. 13C and FIG. 13D. The ¼ wave positive pressure is a real-time mass component acoustically applied to the DD 3 to produce the enhanced low pass performance from the driver 41 as indicated in FIG. 13D for FIG. 6. The drivers' 41 mass and other parameters will affect distortion, efficiency and to some degree extreme frequency cut-off so optimum performance from a certain EATL/Reflex enclosure can be had through driver 41 choice. The efficiency of this type of bass system is still related to actual DD 3 area and it increases with a larger driver 41 as would be normal since more air molecules would be moved. Typically the low frequency output of large drivers 41 increase relative to mid-band output because of diaphragm area as mass deters output at higher frequencies.

Figure 14C:
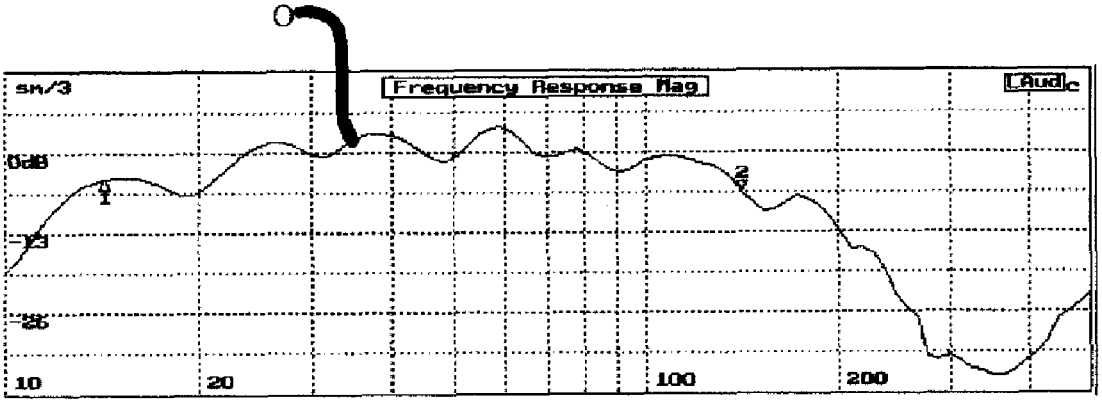

The DCEATL 5 low frequency system develops output from diaphragm area not geometry. The listening room, typically being an acoustic space with dimensional gain, also favors lower frequencies if they are present. The curve of FIG. 14C represents distant microphone placement when measuring the sub-bass system of FIG. 6. The room acts similar to the reflex enclosure in lifting the output at the lower bass frequencies as is seen in curve 0 by the big increase in gain in the 15 Hz octave in FIG. 14C relative to adjacent frequencies. FIG. 14A indicates the impedance of FIG. 5 and FIG. 6. The curves are overlaid to show how little the reflex box alters the resonant frequency and Q of the driver when it is connected. This indicates that the positive pressure within the EATL 5 dominates the drivers' impedance with little effect on the driver 41/EATL 5 operating parameters from the addition of the acoustic low pass filter.

In FIG. 14A the large peak K represents the impedance of the driver in FIG. 5. The small peak J trailing the driver peak L in FIG. 14A would be considered the ports peak with a conventional reflex enclosure and the output would fall off rapidly as the frequency approaches this peak. This peak represents the same EATL 5 peak that was observed in the impedance peak of FIG. 12B, FIG. 13A, FIG. 13B except that it has been pushed below the driver resonance due to the close coupling of the EATL5. It has been shown that increasing the length of the EATL5 will lower the EATL5 peak, as close coupling will also cause. Depth migration is greater under high pressure causing the ¼ wave signal to appear at the driver diaphragm below box tuning.

As shown in FIG. 13D, the output will fall after the main EATL 5 peak but the close coupling will load the driver to the EATL5 cut-off frequency of near 15 Hz. If it is observed carefully the output curve R of FIG. 13D of the sub-bass enclosure FIG. 6 has its highest output at the EATL 5 peak of 35 Hz which is an extraordinary feature. The reason for this can be seen if the curves of FIG. 14D are observed. FIG. 14D represents the phase curves of the subwoofer in FIG. 6. The curves are overlaid to show their relationships. Curve M represents the microphone placement very close to the driver diaphragm at its surface boundary area 24 where it will show the curve of the EATL5. Curve N is indicating the output at the port 17 of the same sub-bass speaker of FIG. 6 and it can clearly be seen a large shift in phase beginning at 55 Hz which is near the box tuning frequency. The outputs of the DD 3 and the port 17 are remarkably similar until the phase begins to shift at the box frequency G of FIG. 14A producing the initial rise in output as seen in curve R FIG. 13D at G. The phase curve M FIG. 14D of the driver indicates a reverse change beginning at near the same point 55 Hz with a small depression indicated throughout the remainder of the phase curve at the driver. This depression represents the high pressure being applied to the diaphragm to produce the phase change at the port and the corresponding increase in output. This pressure is applied at the time when the DD3 is under box loading for maximum effectiveness. The pressure on the diaphragm remains constant as viewed by the flat phase curve to 55 Hz and doesn't change even when the EATL Speak further loads the diaphragm to cause the increased output. The result of the EATL5 feedback and the box loading establishes an effective acoustic low pass system that will allow any practical driver diameter to produce very low frequencies at efficiencies relative to the driver diameter even if the resonance frequency is much higher.

Horn loading of the driver for low frequency reproduction while in the DC compression mode of operation can be effective if physical space isn't a real consideration. The well-loaded driver 41 is a good candidate for horn coupling to the ambient but large surface expansion areas are required to support launching of the long waves. In some cases embedded applications in buildings or large structures will allow portions of the structure to act as horn wave-guides. In some cases folding of the required waveguides will allow implementation of a low frequency horn even an enclosure version.

Figure 8:
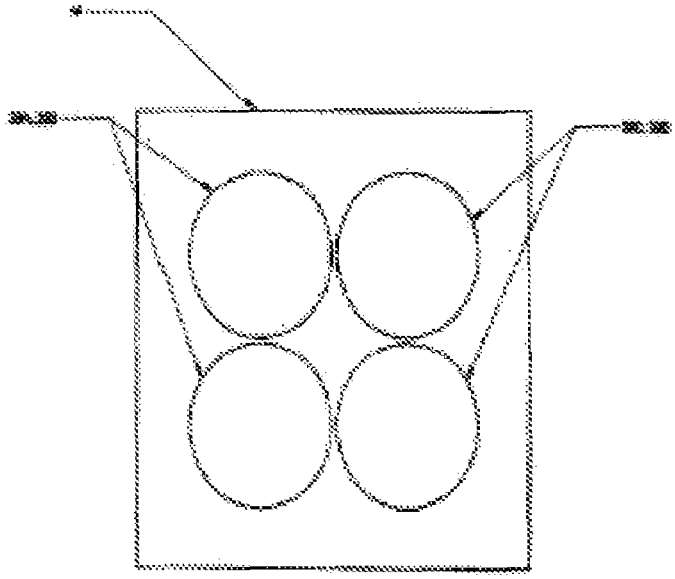
FIG. 8A illustrates a multi-way frequency divided IDC EATL system.
FIG. 8B is illustrates a cluster of DRE or IRE EATL enclosures to increase SPL in a single range.
Figure 8:
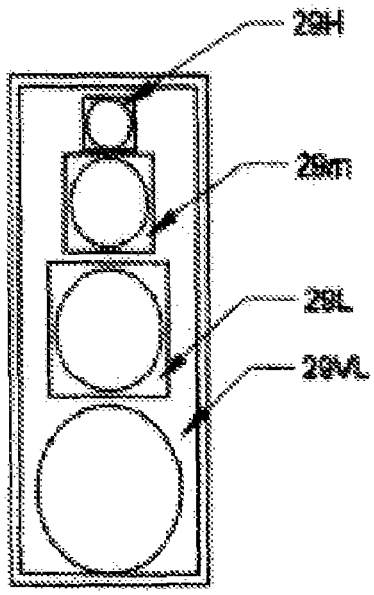

With the EATL5 DRE29D enclosures multiple units of the IRE291 may be configured to increase the output as a combined coherent source as in FIG. 8A the sound will more approach the theoretical 6 db per doubling of units. This and the excellent immunity to the rooms' reflections will maintain the integrity of the source. The IRE 291 may also be combined as in FIG. 8B to have the EATL 5 peak to occur in different ranges to maximize the output in each range. This will allow for maximum low frequency output over a wider range.

Figure 6:
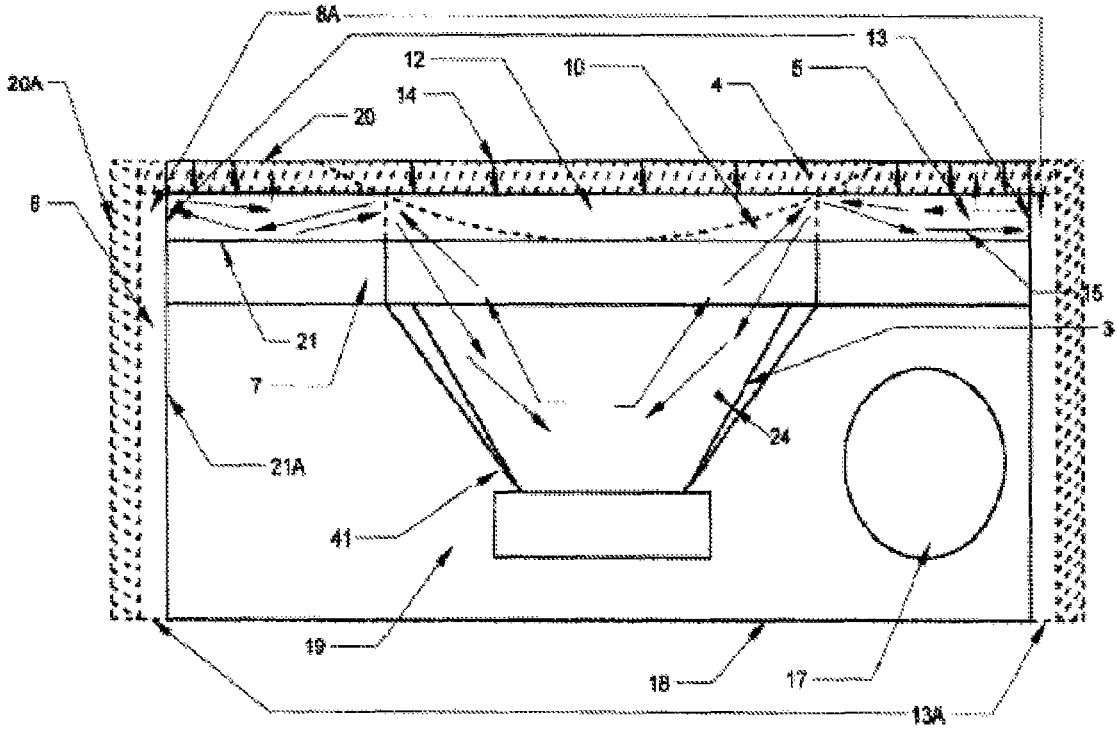
FIG. 6 is a cross section view of the DC EATL physically combined with a standard non-damped bass reflex enclosure.

An example of an application of the IDC and DC systems used concurrently for a single sound system is illustrated by the graph of FIG. 14B. The curve in FIG. 14B represents coverage of the audio range from below 35 Hz to 20 kHz using 3 identical 3-inch diameter drivers operating in almost identically sized miniature (<0.06 cu. ft.) DRE and IRE enclosures as depicted in FIG. 1 and FIG. 6. They are the left speaker FIG. 1, the right speaker FIG. 1 and the subwoofer FIG. 6 that reproduces the lower bass from both channels. The 3-inch driver 41 as in FIG. 1 is the only candidate for a system of this type because it retains the dispersion properties required of a tweeter or high frequency driver but has enough diaphragm area making it capable of having its impedance matched by both the DC or IDC coupled EATL5 to cover the entire frequency range. The free-air resonance of the driver is 100 Hz normally much to high for subwoofer operation yet the DC EATL/Reflexenclosure 29D covers the range from below 35 Hz to 125 Hz where it mates with an IDCEATLenclosure 291, which covers the range from 125 Hz to 20 kHz. The DC EATL/Reflexlow frequency system has its upper frequency range adjusted electronically and is powered by a separate amplifier so that it can be set to properly blend with the IDC EATLenclosure 291 in any field environment. This system achieves near perfect vertical and horizontal off-axis response and requires no additional parts within the enclosures.

The system output illustrated in FIG. 14B is capable of achieving in excess of 90 db output at the listening position in an average size room for the indicated frequency range. This system including 2 speakers, subwoofer, amplifier, tripod stands and all connecting accessories fits neatly in a standard executive sized briefcase and exists today.

Figure 15A:
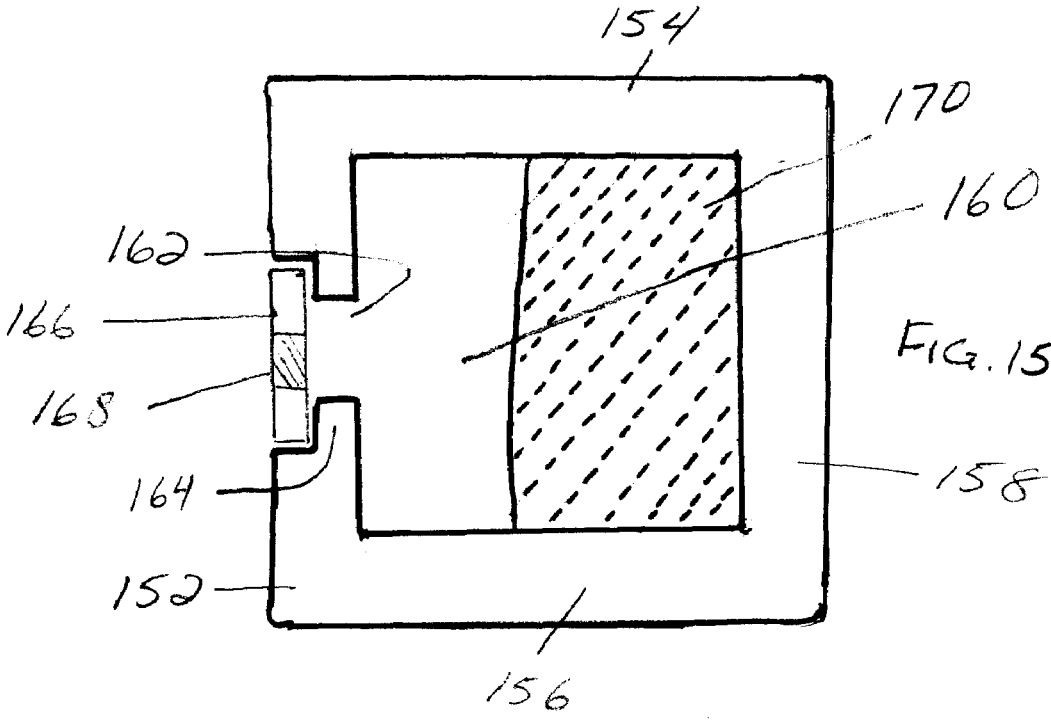
FIGS. 15A and 15B are a side cross-sectional view and a front view of a sound enhancement module.
Figure 15B:
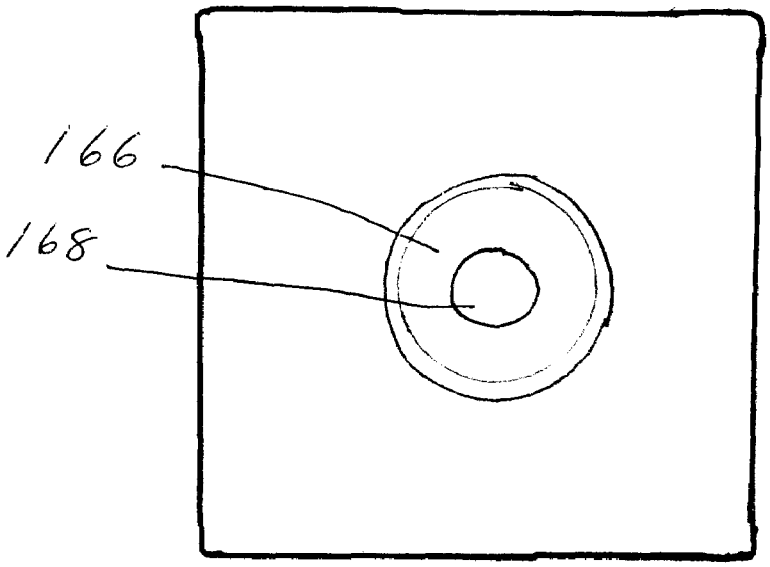

Referring to FIGS. 15A and 15B, a sound enhancement module includes a set of front 152, top 154, bottom 156, rear 158 side (not shown) walls that defines an enclosed chamber 160. The front wall has a circular aperture 162 surrounded by a recessed shelf or ledge 164. A circular disc 166 with a central opening 168 is positioned in the shelf.

Closed cell foam 170 or another type of alternative density medium is positioned in the enclosed chamber 160. The section of closed cell foam 170 may be large enough to fill the entire space of the enclosed chamber 160. In another embodiment, the closed cell foam 170 is adhered to the rear wall 158 and takes up only a portion of the space of the enclosed chamber 160.

The sound enhancement module can be added to many different types of sound-producing devices to improve the sound quality of the device. For example, the module may be added to audio speakers that are installed in separate cabinets or in video displays. The module can also be added to the inside or outside of headphones. The sound enhancement module may also be used to retrofit existing speaker systems that are held in stock or are present at customer locations.

In another embodiment, more than one sound enhancement module is installed inside a speaker cabinet. Each of the sound enhancement modules may be configured to improve the sound quality within a specific audio frequency range.

Changes may be made in the above apparatus without departing from the scope of the invention herein involved. Thus, all matter in the above description or shown in the accompanying drawing are illustrative and not limited to the specific embodiments. Accordingly, other implementations are within the scope of the following claims.

I claim:

1. A sound enhancement module positionable within the interior of a speaker cabinet, comprising:

a set of walls defining an enclosed chamber;

an aperture in one of the walls to provide a path for audio waves to travel between the enclosed chamber and an external space;

a shelf surrounding the aperture;

a disc attached to the shelf, the disc having a central opening coaxially arranged with the aperture; and an alternative density transmission medium positioned in the enclosed chamber.

2. The sound enhancement module of claim 1, wherein the disc comprises a central opening coaxially positioned relative to the aperture wherein the aperture is a circular aperture.

3. The sound enhancement module of claim 1, wherein the disc comprises a metal disc.

4. The sound enhancement module of claim 1, wherein an outer surface of the disc is flush with an outer surface of one of the walls.

5. The sound enhancement module of claim 1, wherein the set of one or more walls comprises a set of six walls configured as a rectangular box.

6. The sound enhancement module of claim 1, wherein the set of one or more walls comprises a composite wood material.

7. The sound enhancement module of claim 1, wherein the enclosed chamber defines a cylindrical volume.

8. The sound enhancement module of claim 1, wherein the alternative density transmission medium comprises open cell foam.

9. A sound enhancement module, comprising:

walls defining an enclosed chamber;

an aperture in one of the walls to provide a path for audio waves to travel between the enclosed chamber and an external space;

a shelf surrounding the aperture;

a disc positioned on the shelf such that a circular opening of the disc is coaxially positioned relative to the aperture; and an alternative density transmission medium positioned in the enclosed chamber.

10. The sound enhancement module of claim 9, wherein:

the walls comprise a front wall and a back wall;

the front wall includes the shelf, the aperture and the enclosed chamber; and the back wall comprises a rectangular panel that attaches to the front wall.

11. The sound enhancement module of claim 10, wherein:

the shelf comprises a first circular bore in the front wall; and the aperture comprises a second circular bore in the front wall.

12. A method of improving the sound quality from a speaker system with a sound enhancement module, the sound enhancement module having walls defining an enclosed chamber, an aperture in one of the walls to provide a path for audio waves to travel between the enclosed chamber and an external space, a circular disc with an opening positioned in the aperture and an alternative density transmission medium positioned in the enclosed chamber, the method comprising:

retrofitting the speaker system with the sound enhancement module.

13. The method of claim 12, wherein retrofitting the speaker system comprises:

removing a wall of a speaker cabinet;

fixing the sound enhancement module to the inside of the speaker cabinet; and reattaching the wall of the speaker cabinet.

14. The method of claim 13, further comprising:

positioning the center of the aperture along a central axis of a speaker in the speaker cabinet.

15. The method of claim 13, further comprising:

positioning the sound enhancement module behind a speaker attached to a front wall of the speaker cabinet.

16. The method of claim 13, wherein fixing the sound enhancement module to the inside of the speaker cabinet comprises fixing the sound enhancement module to a rear wall of the speaker cabinet.

17. The method of claim 1, wherein:

a speaker driver is affixed to a front wall of a speaker cabinet;

the sound enhancement module is positioned behind said speaker driver; and the sound enhancement module is fixed to a rear wall of said speaker cabinet

18. The method of claim 9, wherein:

a speaker driver is affixed to a front wall of a speaker cabinet;

the sound enhancement module is positioned behind said speaker driver; and the sound enhancement module is fixed to a rear wall of said speaker cabinet.

* * * * *